US010814575B2

(12) United States Patent
Masato et al.

(10) Patent No.: US 10,814,575 B2
(45) Date of Patent: Oct. 27, 2020

(54) PRESS MACHINE

(71) Applicant: KOMATSU INDUSTRIES CORPORATION, Kanazawa-shi, Ishikawa (JP)

(72) Inventors: Yusuke Masato, Kanazawa (JP); Hisanori Takeuchi, Kanazawa (JP)

(73) Assignee: KOMATSU INDUSTRIES CORPORATION, Kanazawa-shi, Ishikawa (JP)

( * ) Notice: Subject to any disclaimer, the term of this patent is extended or adjusted under 35 U.S.C. 154(b) by 581 days.

(21) Appl. No.: 15/529,699

(22) PCT Filed: Sep. 9, 2015

(86) PCT No.: PCT/JP2015/075553
§ 371 (c)(1),
(2) Date: May 25, 2017

(87) PCT Pub. No.: WO2016/103798
PCT Pub. Date: Jun. 30, 2016

(65) Prior Publication Data

US 2017/0334160 A1 Nov. 23, 2017

(30) Foreign Application Priority Data

Dec. 26, 2014 (JP) ..... 2014-264741

(51) Int. Cl.
*B30B 11/00* (2006.01)
*B30B 15/28* (2006.01)
(Continued)

(52) U.S. Cl.
CPC ..... *B30B 11/005* (2013.01); *B30B 1/18* (2013.01); *B30B 1/263* (2013.01); *B30B 15/00* (2013.01);
(Continued)

(58) Field of Classification Search
CPC ..... B30B 15/10; B30B 15/14; B30B 15/142; B30B 15/148; B30B 15/16; B30B 15/166;
(Continued)

(56) References Cited

U.S. PATENT DOCUMENTS 4,048,886 A * 9/1977 Zettler ..... B30B 15/28 83/58
5,293,024 A 3/1994 Sugahara et al.
(Continued)

FOREIGN PATENT DOCUMENTS

CN 1122749 A 5/1996
CN 1700981 A 11/2005
(Continued)

*Primary Examiner* — Adam J Eiseman
*Assistant Examiner* — Stephen Floyd London
(74) *Attorney, Agent, or Firm* — Faegre Drinker Biddle & Reath LLP

(57) ABSTRACT

A drive unit drives a slide which vertically reciprocates for pressing the workpiece. A detection unit detects positional information about the slide. A speed control unit controls the speed of the slide by the drive unit, based on motion information defining operation of the slide. A stoppage determination calculation unit sets a deceleration start point at which deceleration of the slide is to be started, based on the motion information and a set point at which the slide is to be forced to stop. A speed control unit determines whether an abnormality signal regarding transportation of the workpiece is input, when the slide reaches the deceleration start point based on the positional information about the slide detected by the detection unit. The speed control unit performs deceleration control for the slide so that the slide is stopped at the set point, when determining that the abnormality signal is input.

4 Claims, 10 Drawing Sheets

(51) Int. Cl.

| | |
|---|---|
| ***B30B 15/00*** | (2006.01) |
| ***B30B 15/14*** | (2006.01) |
| ***B30B 1/26*** | (2006.01) |
| ***B30B 1/18*** | (2006.01) |
| ***B30B 15/30*** | (2006.01) |

(52) U.S. Cl.
CPC ..... *B30B 15/14* (2013.01); *B30B 15/28* (2013.01); *B30B 15/285* (2013.01); *B30B 15/30* (2013.01)

(58) Field of Classification Search
CPC ..... B30B 15/26; B30B 15/28; B30B 15/285; F16P 7/02
See application file for complete search history.

(56) References Cited

U.S. PATENT DOCUMENTS

| | | | | |
|---|---|---|---|---|
| 2003/0116037 | A1* | 6/2003 | Tanaka | B30B 15/0041 100/282 |
| 2006/0011039 | A1 | 1/2006 | Kanemitsu et al. | |
| 2008/0307982 | A1* | 12/2008 | Hirotani | B30B 15/0041 100/48 |
| 2010/0192787 | A1 | 8/2010 | Onishi et al. | |
| 2011/0109257 | A1* | 5/2011 | Someya | B30B 15/142 318/626 |
| 2014/0260495 | A1* | 9/2014 | Kohno | B21D 22/20 72/347 |

FOREIGN PATENT DOCUMENTS

| | | | | | |
|---|---|---|---|---|---|
| CN | 101808814 | A | | 8/2010 | |
| JP | S61-162400 | U | | 10/1986 | |
| JP | S63-256391 | A | | 10/1988 | |
| JP | H05-158520 | A | | 6/1993 | |
| JP | H10-166193 | A | | 6/1998 | |
| JP | 2000-222014 | A | | 8/2000 | |
| JP | 2005-21934 | A | | 1/2005 | |
| JP | 2005021934 | A | * | 1/2005 | B30B 15/285 |
| JP | 3818748 | B2 | * | 9/2006 | B30B 1/186 |
| JP | 2008-543586 | A | | 12/2008 | |
| JP | 2009-101377 | A | | 5/2009 | |
| JP | 2009101377 | A | * | 5/2009 | |
| JP | 2010131656 | A | * | 6/2010 | |
| JP | 5158467 | B2 | * | 3/2013 | B21D 43/10 |
| JP | 2013-248642 | A | | 12/2013 | |
| WO | WO 2006/135961 | A1 | | 12/2008 | |

* cited by examiner

FIG.8

(A)

SET POINT SETTING SCREEN

PLEASE INPUT THE POSITION OR THE ANGLE OF THE SET POINT.

P1 OR Q1

OK (B)

POSITION OF DECELERATION START POINT P2

ANGLE OF DECELERATION START POINT Q2

POSITION OF SET POINT P1

ANGLE OF SET POINT Q1

PRESS MACHINE

TECHNICAL FIELD

The present invention relates to a press machine, and particularly relates to a press machine transporting and pressing a workpiece.

BACKGROUND ART

A press machine configured as an electric servo press includes a servo motor, a power conversion mechanism, and a brake apparatus, for example. The power conversion mechanism includes a ball screw, an eccentricity mechanism, and a link mechanism, for example, and converts a rotational driving force of the servo motor into an up-and-down reciprocating motion (vertical reciprocation) of a slide. The reciprocating motion of the slide allows a workpiece to undergo press working between an upper die and a lower die.

Such a press machine is disclosed for example in Japanese Patent Laying-Open No. 2009-101377. According to this publication, a deceleration start position is set higher than a setting error detection position. When a descending slide reaches the set deceleration start position, deceleration control for the slide is started. If an error (workpiece (material) is not normally transported) is detected at the setting error detection position, the slide is forced to stop at a forced stop position. If no error is detected at the setting error detection position, acceleration control is performed to set the decelerated speed of the slide back to its original working speed based on motion information.

CITATION LIST

Patent Document

PTD 1: Japanese Patent Laying-Open No. 2009-101377

SUMMARY OF INVENTION

Technical Problem

Under the control for the press machine in the above publication, the slide is decelerated, before any error is detected, at the deceleration start position located higher than the setting error detection position, which leads to a problem that the productivity decreases due to the deceleration.

The present invention has been made in view of the above problem, and an object of the invention is to provide a press machine that forces a slide to stop when an abnormality arises in transportation of a workpiece, but can still suppress decrease of the productivity.

Solution to Problem

A press machine in accordance with the present invention is a press machine configured to transport and press a workpiece and includes a slide, a drive unit, a detection unit, a speed control unit, and a stoppage determination calculation unit. The slide is configured to vertically reciprocate for pressing the workpiece. The drive unit is configured to drive the slide. The detection unit is configured to detect positional information about the slide. The speed control unit is configured to control a speed of the slide by the drive unit, based on motion information defining operation of the slide. The stoppage determination calculation unit is configured to set a deceleration start point at which deceleration of the slide is to be started, based on the motion information and a set point at which the slide is to be forced to stop. The speed control unit is configured to determine whether an abnormality signal regarding transportation of the workpiece is input, when the slide reaches the deceleration start point based on the positional information about the slide detected by the detection unit, and perform deceleration control for the slide so that the slide is stopped at the set point, when the speed control unit determines that the abnormality signal is input.

In accordance with the present invention, the speed control unit determines whether the abnormality signal is input, at the deceleration start point, and performs deceleration control so that the slide is stopped at the set point, when determining that the abnormality signal is input. Thus, when the abnormality signal regarding transportation of the workpiece is input, the slide can be forced to stop.

Since whether the abnormality signal is input is determined at the deceleration start point, the pressing operation is continued without the deceleration control, when the speed control unit determines that the abnormality signal is not input. Since deceleration control is not performed, decrease of the productivity can be suppressed.

Accordingly, decrease of the productivity can be suppressed while the slide is forced to stop if there is an abnormality regarding transportation of the workpiece.

Preferably, the press machine further includes a display unit configured to display the set deceleration start point.

In accordance with the present invention, the deceleration start point is displayed on the display unit, and an operator can therefore confirm the deceleration start point easily.

Preferably, the stoppage determination calculation unit is configured to receive input of the set point at which the slide is to be forced to stop.

In accordance with the present invention, the set point can be input and therefore, the slide can be forced to stop at any point.

Preferably, the speed control unit is configured to determine whether input of the abnormality signal ends, when the speed control unit determines that the abnormality signal is input, and perform acceleration control for the slide by the drive unit based on the motion information, when the speed control unit determines that input of the abnormality signal ends.

In accordance with the present invention, when it is determined that input of the abnormality signal ends, the deceleration control for the slide is stopped and press working is performed under acceleration control. Accordingly, decrease of the productivity can be suppressed.

Preferably, the press machine further includes: a count unit configured to count a period for which the slide is stopped at the set point; and a stoppage process unit configured to stop supply of electric power from a power supply, when the slide is stopped for a predetermined period or more based on a result of counting by the count unit.

In accordance with the present invention, supply of electric power from a power supply is stopped when the slide is stopped at the set point for a predetermined period or more, and thereby the safety in the abnormal state can be increased.

A press machine in accordance with the present invention is a press machine configured to transport and press a workpiece, and includes a slide, a drive unit, a detection unit, and a speed control unit. The slide is configured to vertically reciprocate for pressing the workpiece. The drive unit is configured to drive the slide. The detection unit is configured to detect positional information about the slide. The speed control unit is configured to control a speed of the slide by the drive unit, based on motion information defining operation of the slide. The speed control unit is configured to perform deceleration control so that the slide is forced to stop at a set point, in response to input of an abnormality signal regarding transportation of the workpiece, and restart control of the speed of the slide by the drive unit from the set point based on the motion information, when input of the abnormality signal ends.

In accordance with the present invention, the slide can be forced to stop, when the abnormality signal regarding transportation of the workpiece is input. When input of the abnormality signal ends, control of the speed of the slide is restarted and thus the press working is continued. In this way, decrease of the productivity can be suppressed while the slide is forced to stop when there is an abnormality regarding transportation of the workpiece.

Preferably, the press machine further includes a stoppage determination unit. The stoppage determination unit is configured to set a deceleration start point at which deceleration of the slide is to be started, based on the motion information and the set point at which the slide is to be forced to stop. The speed control unit is configured to determine whether the abnormality signal is input, when the slide reaches the deceleration start point based on the positional information about the slide detected by the detection unit, and perform deceleration control for the slide so that the slide is stopped at the set point, when the speed control unit determines that the abnormality signal is input.

In accordance with the present invention, the speed control unit determines whether the abnormality signal is input, at the deceleration start point, and performs deceleration control so that the slide is stopped at the set point, when determining that the abnormality signal is input. Thus, when the abnormality signal regarding transportation of the workpiece is input, the slide can be forced to stop.

Since whether the abnormality signal is input is determined at the deceleration start point, the pressing operation is continued without the deceleration control, when the speed control unit determines that the abnormality signal is not input. Since deceleration control is not performed, decrease of the productivity can be suppressed. Preferably, the press machine further includes a display unit configured to display the set deceleration start point.

In accordance with the present invention, the deceleration start point is displayed on the display unit, and an operator can therefore confirm the deceleration start point easily.

Preferably, the stoppage determination calculation unit is configured to receive input of the set point at which the slide is to be forced to stop.

In accordance with the present invention, the set point can be input and therefore, the slide can be forced to stop at any point.

Preferably, the speed control unit is configured to determine whether input of the abnormality signal ends while the slide is stopped at the set point, and perform acceleration control for the slide by the drive unit from the set point based on the motion information, when the speed control unit determines that input of the abnormality signal ends.

In accordance with the present invention, the press working is performed under acceleration control from the set point, when it is determined that input of the abnormality signal ends. In this way, decrease of the productivity can be suppressed.

Preferably, the press machine further includes: a count unit configured to count a period for which the slide is stopped at the set point; and a stoppage process unit configured to stop supply of electric power from a power supply, when the slide is stopped for a predetermined period or more based on a result of counting by the count unit.

In accordance with the present invention, supply of electric power from a power supply is stopped, when the slide is stopped at the set point for a predetermined period or more. In this way, the safety in the abnormal state can be increased.

Advantageous Effects of Invention

The press machine of the present invention forces the slide to stop when an abnormality arises in transportation of a workpiece, but can still suppress decrease of the productivity.

BRIEF DESCRIPTION OF DRAWINGS

FIGS. 8A and 8B are diagrams illustrating display screens shown on a control panel 6 based on an embodiment.

DESCRIPTION OF EMBODIMENTS

Figure 1:
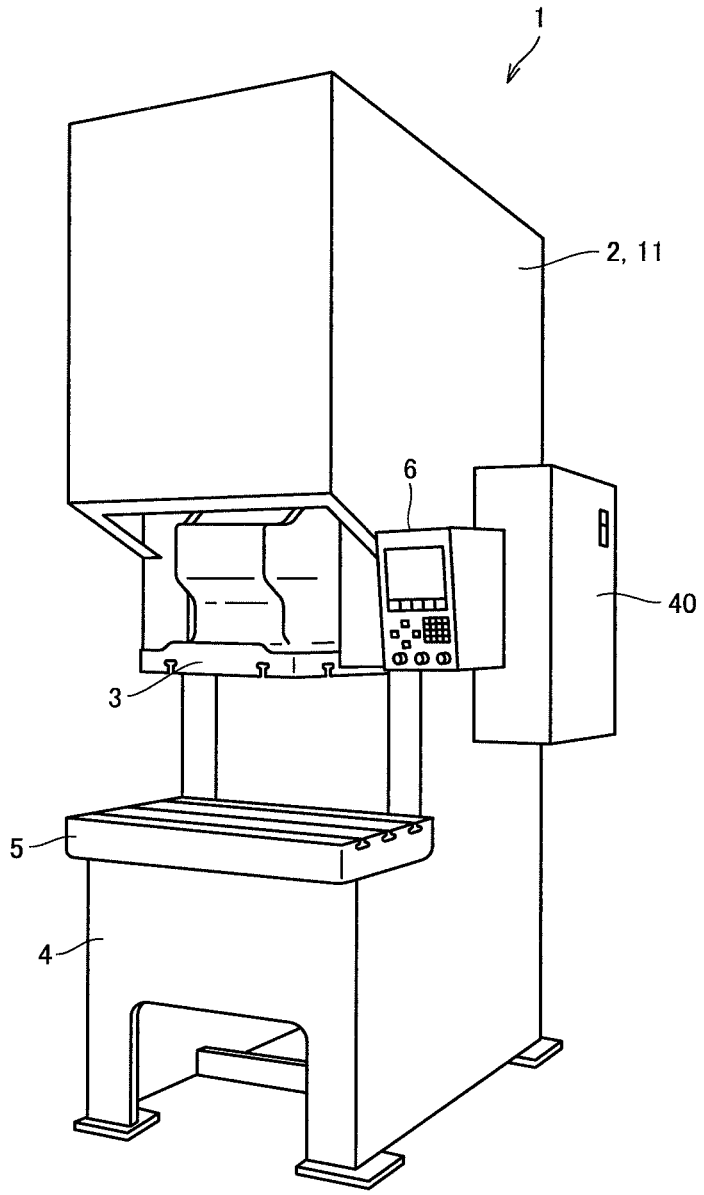
FIG. 1 is a perspective view of a servo press 1 based on an embodiment.

An embodiment will be described in detail with reference to the drawings. In the drawings, the same or corresponding parts are denoted by the same reference characters, and a description thereof will not be repeated.

In the present example, a servo press (press machine) equipped with a servo motor will be exemplarily described.

<Overall Configuration>

FIG. 1 is a perspective view of a servo press 1 based on an embodiment.

As shown in FIG. 1, servo press 1 of the type equipped with no plunger is illustrated by way of example.

Servo press 1 includes a body frame 2, a slide 3, a bed 4, a bolster 5, a control panel 6, and a control device 40.

At a substantially central position of body frame 2 of servo press 1, slide 3 is supported to be movable up and down. Below slide 3, bolster 5 attached onto bed 4 is disposed. At a front portion of body frame 2, control panel 6 is disposed. On a lateral side of body frame 2, control device 40 to which control panel 6 is connected is disposed.

Figure 2:
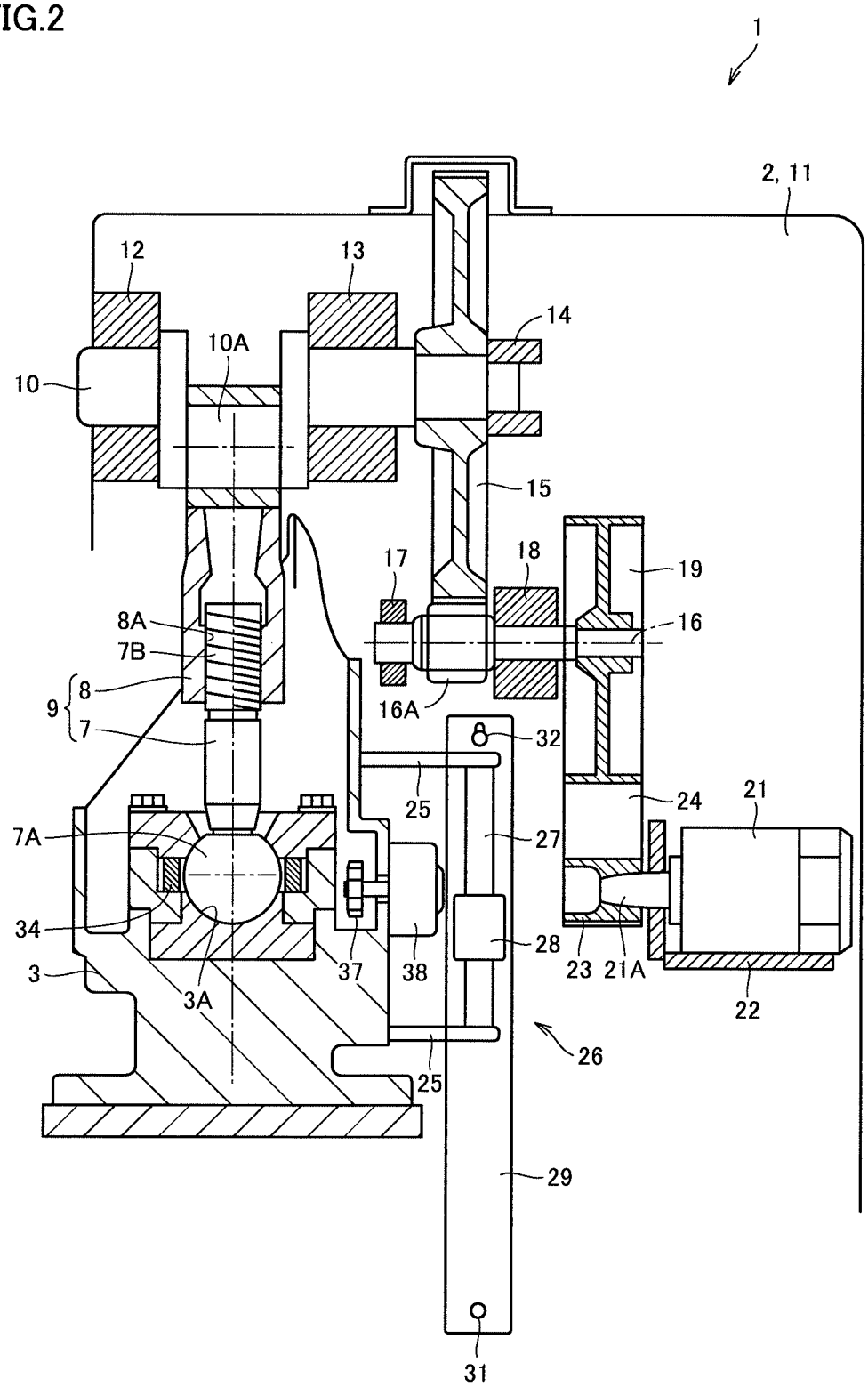
FIG. 2 is a side cross-sectional view showing principal parts of servo press 1 based on an embodiment.

FIG. 2 is a side cross-sectional view showing principal parts of servo press 1 based on an embodiment.

Figure 3:
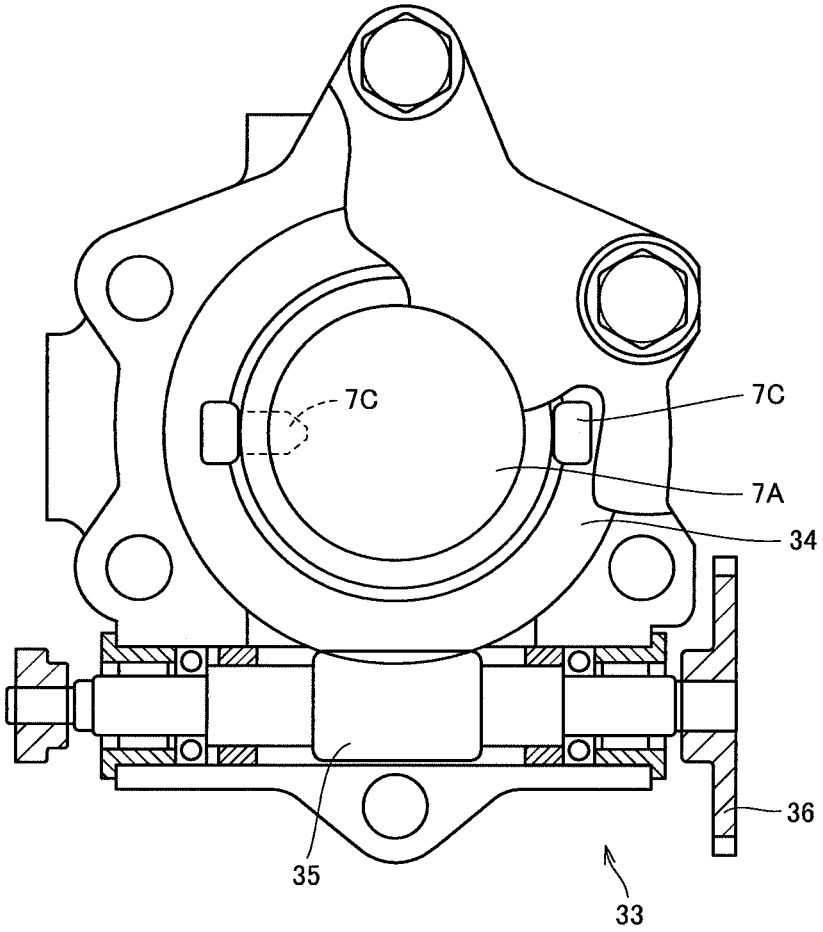
FIG. 3 is a plan view of a partial cross section showing other principal parts of servo press 1 based on an embodiment.

FIG. 3 is a plan view of a partial cross section showing other principal parts of servo press 1 based on an embodiment.

As shown in FIG. 2, servo press 1 further includes a servo motor 21, a spherical hole 3A, a screw shaft 7, a sphere 7A, a thread 7B, a connecting rod body 8, a female thread 8A, a connecting rod 9, a main shaft 10, an eccentric portion 10A, a side frame 11, bearings 12 to 14, a main gear 15, a power transmission shaft 16, a transmission gear 16A, bearings 17, 18, and a pulley 19.

In servo press 1, servo motor 21 drives slide 3. In spherical hole 3A formed in an upper portion of slide 3, sphere 7A for adjusting the die height is rotatably inserted in such a manner that prevents sphere 7A disposed at the lower end of screw shaft 7 from falling out. Spherical hole 3A and sphere 7A form a spherical joint. Thread 7B of screw shaft 7 is exposed upward from slide 3 and screwed in female thread 8A of connecting rod body 8 disposed above screw shaft 7. Screw shaft 7 and connecting rod body 8 form extendable connecting rod 9.

The die height refers to the distance from the lower surface of the slide to the upper surface of the bolster with slide 3 set at the bottom dead center.

An upper portion of connecting rod 9 is rotatably coupled to crank-shaped eccentric portion 10A disposed on main shaft 10. Main shaft 10 is supported between a pair of right and left thick-plate-shaped side frames 11 which form body frame 2, by bearings 12, 13, 14 at respective three positions arranged in the front-rear direction. To the rear side of main shaft 10, main gear 15 is attached.

Main gear 15 meshes with transmission gear 16A of power transmission shaft 16 disposed below main gear 15. Power transmission shaft 16 is supported between side frames 11 by bearings 17, 18 arranged in the front-rear direction. To the rear end of power transmission shaft 16, pulley 19 to be driven is attached. Pulley 19 is driven by servo motor 21 disposed below pulley 19.

Servo press 1 further includes a bracket 22, an output shaft 21A, a pulley 23, a belt 24, a bracket 25, a position detector 26, a rod 27, a position sensor 28, an auxiliary frame 29, and bolts 31, 32.

Servo motor 21 is supported between side frames 11 with substantially L-shaped bracket 22 located therebetween. Output shaft 21A of servo motor 21 protrudes in the front-rear direction of servo press 1. Motive power is transmitted by belt 24 wound around driven pulley 19 and driver pulley 23 which is disposed on output shaft 21A.

To the back side of slide 3, a pair of brackets 25 is attached that protrude rearward from two positions, namely the upper position and the lower position, toward the space between side frames 11. Between upper and lower brackets 25, rod 27 forming a part of position detector 26 such as linear scale is attached. This rod 27 is equipped with a scale for detecting the position in the top-bottom direction of slide 3, and inserted to be movable up and down through position sensor 28 which also forms a part of position detector 26. Position sensor 28 is secured to auxiliary frame 29 disposed on one side frame 11.

Auxiliary frame 29 is formed in a vertically elongate shape, has its lower portion attached to side frame 11 with bolt 31 and its upper portion supported slidably up and down with bolt 32 which is inserted in a vertically long, hole. Thus, only one of the upper side and the lower side (the lower side in the present embodiment) of auxiliary frame 29 is secured to side frame 11, and the other side thereof is supported movably up and down. Therefore, auxiliary frame 29 is not influenced by elongation/contraction, due to temperature variation, of side frames 11. In this way, position sensor 28 is capable of accurately detecting the slide position and the die height position without being influenced by such elongation/contraction of side frames 11.

In contrast, the slide position and the die height of slide 3 are adjusted by a slide position adjustment mechanism 33 disposed in slide 3. As also shown in FIG. 3, slide position adjustment mechanism 33 includes a warm wheel 34 attached to the outer periphery of sphere 7A of screw shaft 7 with a pin 7C, a warm gear 35 meshing with warm wheel 34, an input gear 36 attached to an end of warm gear 35, and an induction motor 38 having an output gear 37 meshing with input gear 36. Induction motor 38 has a flat shape having a relatively shorter axial length and is formed compactly. Rotational motion of induction motor 38 is adjusted by rotating screw shaft 7 through warm wheel 34.

Control panel 6 is used for entering various types of data for setting motion control for the slide, and has a display which shows a switch and ten keys for entering motion data as well as the input data and setting data having been set and registered.

As the display, a programmable display having a clear touch switch panel mounted on the front face of a graphic display such as liquid crystal display or plasma display is used.

Control panel 6 may also include a data input device for data from an external storage medium such as such as IC card on which stored motion data set in advance, or include a communication device for transmitting/receiving data in the wireless manner or through a communication line.

From control panel 6 in the embodiment, a working pattern appropriate for molding conditions, namely a slide control pattern can be selected and set, such as rotation pattern, rotational reciprocation pattern, pendulum pattern, and reverse pattern. Moreover, depending on the working pattern, the motion data is defined to specify whether to show the height position of slide 3 by the actually detected value of position detector 26 or by the value calculated by operation as described later herein.

The "rotation" pattern which is one of the control patterns is implemented by rotating main shaft 10 in only the positive rotational direction, and refers to a motion of causing slide 3 to start moving from the top dead center, pass the bottom dead center, and reach again the top dead center, per Movement of one shot with respect to a workpiece.

The "rotational reciprocation" pattern refers to a motion of causing slide 3, per movement of one shot with respect to a workpiece, to start moving from the top dead center in the positive rotational direction, stop at a working end position before the bottom dead center, and rotate from this position in the opposite direction to return to the top dead center, and causing slide 3, per movement of one shot with respect to the next workpiece, to start moving from the top dead center in the reverse rotational direction, stop at a working end position before the bottom dead center, and rotate from this position in the positive rotational direction to return to the top dead center. Namely, main shaft 10 alternately makes the positive rotation and the reverse rotation each per workpiece.

"Pendulum pattern" causes slide 3, per movement of one shot with respect to a workpiece, to start moving from the top dead center or an upper limit point lower than the top dead center in the positive rotational direction, pass the bottom dead center, and stop at the top dead center or the upper limit point before the top dead center. Then, for the shot with respect to the next workpiece, slide 3 is caused to start moving in the reverse rotational direction, pass the bottom dead center, and reach the top dead center or the original upper limit point to stop. Namely, main shaft 10 alternately makes the positive rotation and the negative rotation for each workpiece.

The "reverse pattern" refers to a motion, per movement of one shot with respect to a workpiece, of causing slide 3 to start moving from the top dead center or an upper limit point lower than the top dead center in the positive rotational direction, stop at a working end position before the bottom dead center, and rotate from this working end position in the reverse rotational direction to return to the top dead enter or the upper limit point. Namely, main shaft 10 makes positive and negative rotations per shot.

It should be noted that slide 3 and servo press 1 are respective examples of "slide" and "press machine" of the present invention.

<System Configuration>

Figure 4:
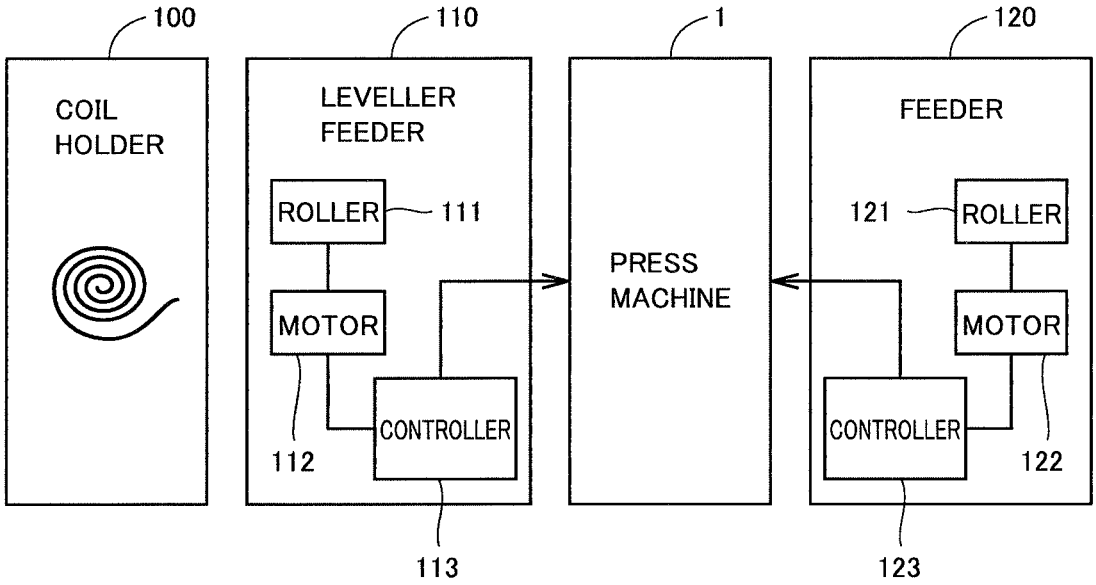
FIG. 4 is a diagram illustrating a configuration of a press system based on an embodiment.

FIG. 4 is a diagram illustrating a configuration of a press system based on an embodiment.

As shown in FIG. 4, the press system includes a coil holder 100, a leveller feeder 110, a servo press 1, and a feeder 120.

A coil is wound around coil holder 100, and the coil is transported through leveller feeder 110 to servo press 1. In the present example, a description will be given of the case where the coil as a workpiece (material) is subjected to press working.

Leveller feeder 110 adjusts the feeding height at which the coil is transported from coil holder 100 to servo press 1, and transports the coil at a predetermined timing toward servo press 1. Specifically, leveller feeder 110 includes a roller 111, a motor 112, and a controller 113.

Motor 112 drives roller 111 to cause the coil to be transported from coil holder 100 to servo press 1. Controller 113 controls motor 112 and controls the timing at which the coil is fed from coil holder 100 to servo press 1. Servo press 1 performs press working on the coil transported from leveller feeder 110 in accordance with a working pattern appropriate for molding conditions selected for the coil transported from leveller feeder 110.

Feeder 120 transports the work molded by the press working in servo press 1. For example, the workpiece can also be transported to the next servo press.

Feeder 120 includes a roller 121, a motor 122, and a controller 123.

Motor 122 drives roller 121 and transports the workpiece molded in servo press 1. Controller 123 controls motor 122 and controls the timing at which the workpiece molded in servo press 1 is transported.

The parts of the press system are synchronized with one another, and a series of operations is successively performed. A coil is transported from coil holder 100 to servo press 1 through leveller feeder 110. The workpiece pressed in servo press 1 is transported by feeder 120. The above-described series of operations is repeated.

Leveller feeder 110 has a function of detecting an abnormality regarding transportation of a workpiece.

Specifically, when motor 112 drives roller 111 to transport a coil, controller 113 determines whether or not the coil is properly transported. When the transportation is improper, controller 113 outputs to servo press 1 an abnormality signal representing a transportation error. For example, when controller 113 detects that a coil having a proper length is not transported due to delay of feeding of the coil from coil holder 100, controller 113 outputs the abnormality signal to servo press 1. When the abnormal state is removed, controller 113 stops outputting the abnormality signal to servo press 1.

Receiving the abnormality signal from controller 113, servo press 1 performs abnormal stoppage control.

Likewise, feeder 120 has a function of detecting an abnormality regarding transportation of a workpiece.

Specifically, controller 123 determines whether or not a workpiece is properly transported from servo press 1 by roller 121 driven by motor 122. When the transportation is improper, controller 123 outputs to servo press 1 the abnormality signal representing a transportation error. For example, when controller 123 detects that the preceding workpiece is not properly transported, controller 123 outputs the abnormality signal to servo press 1. When the abnormal state is removed, controller 123 stops outputting the abnormality signal to servo press 1.

<Functional Configuration of Servo Press>

Next, control device 40 connected to control panel 6 will be described.

The above-described slide control patterns and information about various types of settings are entered through operation of control panel 6, by way of example.

Figure 5:
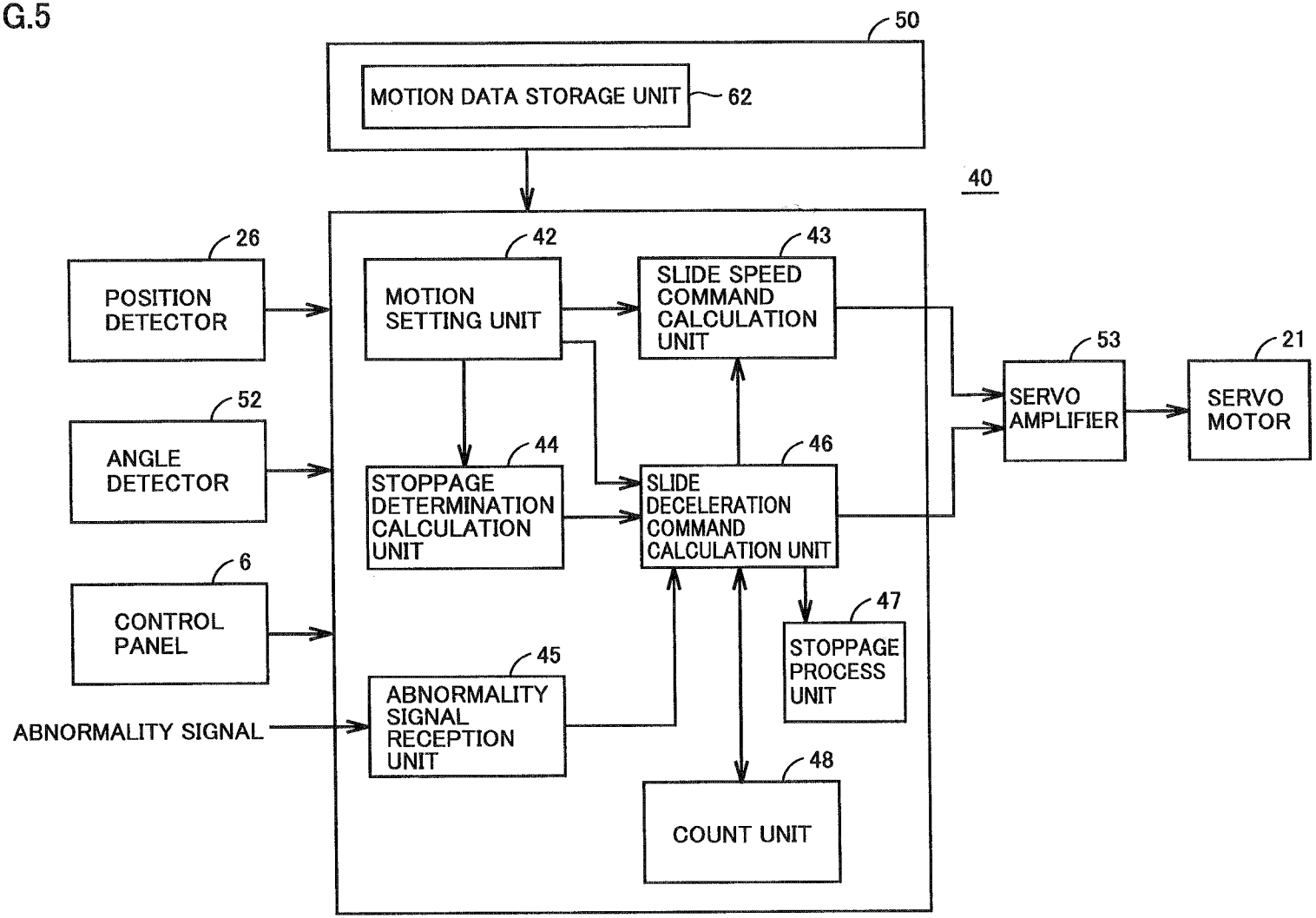
FIG. 5 is a block diagram showing main components of a control device 40 based on an embodiment.

FIG. 5 is a block diagram showing main components of control device 40 based on an embodiment.

In FIG. 5, control device 40 is a device controlling servo motor 21 which drives slide 3, by way of feedback control. While a description of details based on the drawing will not be given, control device 40 is configured to include a CPU, a high-speed numerical processor, or the like as a main component, and also include a computer device performing an arithmetic operation and/or a logical operation on input data in accordance with a predetermined procedure, and an output interface outputting a command current.

Control device 40 based on the embodiment includes a motion setting unit 42, a slide speed command calculation unit 43, a stoppage determination calculation unit 44, an abnormality signal reception unit 45, a slide deceleration command calculation unit 46, a stoppage process unit 47, and a count unit 48.

Control device 40 is connected to a storage unit 50 configured as an appropriate storage medium such as ROM, RAM, or the like. Storage unit 50 includes a motion data storage unit 62 storing programs for control device 40 to implement various functions as well as motion data. Storage unit 50 is also used as a work area for executing various kinds of operational processing.

To controller 40, control panel 6 as well as position detector 26 detecting the height position of slide 3 and an angle detector 52 such as crank encoder detecting the rotational angle of main shaft 10 are connected. Accordingly, control device 40 can acquire the position or angle regarding the height of slide 3. Servo motor 21 is also connected through a servo amplifier 53 to control device 40.

Motion setting unit 42 of control device 40 determines motion data (motion information) for performing control, based on a control pattern selected from and set on control panel 6 and motion data stored in storage unit 50 and corresponding to the selected control pattern. Then, motion setting unit 42 outputs the determined motion data to slide speed command calculation unit 43, stoppage determination calculation unit 44, and slide deceleration command calculation unit 46.

In order to accurately move slide 3 in accordance with respective motions of the positive rotation and the reverse rotation of main shaft 10, namely rotations such as positive rotation of servo motor 21, based on motion data determined by motion setting unit 42, slide speed command calculation unit 43 calculates, based on the motion, a target value of the slide position for each predetermined periodic time of servo calculation. Slide speed command calculation unit 43 then calculates a motor speed command for servo motor 21 based on a difference between the determined target value of the slide position and the slide position detected by position detector 26, so that the difference is reduced, and slide speed command calculation unit 43 outputs the calculated motor speed command to servo amplifier 53. In the present example, a description will be given of a method of control performed in such a manner that reduces the difference between the target value of the slide position and the slide position detected by position detector 26. Alternatively, the control may be performed in such a manner that reduces a difference from the angle of main shaft 10 depending on the slide position detected by angle detector 52.

By the above process, servo motor 21 is properly driven and the speed control is performed so that slide 3 moves at the target speed.

Stoppage determination calculation unit 44 sets a deceleration start point at which deceleration of slide 3 is to be started, based on the motion data and the set point. How to set the deceleration start point will be described later herein.

Receiving an externally input abnormality signal, abnormality signal reception unit 45 outputs the abnormality signal to slide deceleration command calculation unit 46. The abnormality signal is a signal relevant to an abnormality in transportation of a workpiece. In the present example, the abnormality signal is output from controller 113 to servo press 1 when an abnormality in transportation of a workpiece is detected by leveller feeder 110. When an abnormality in transportation of a workpiece is detected by feeder 120, the abnormality signal is output from controller 123 to servo press 1.

When slide 3 reaches the deceleration start point, slide deceleration command calculation unit 46 determines whether or not abnormality signal reception unit 45 receives the abnormality signal. When the abnormality signal is received, slide deceleration command calculation unit 46 instructs slide speed command calculation unit 43 to stop output of a motor speed command from slide speed command calculation unit 43. Moreover, slide deceleration command calculation unit 46 outputs a motor speed command to servo amplifier 53 in order to control deceleration of slide 3. Specifically, slide deceleration command calculation unit 46 performs deceleration control (abnormality stoppage control) so that slide 3 is stopped at a set point where slide 3 is to be forced to stop.

In the above-described process, when the abnormality signal regarding transportation of a workpiece is input, slide 3 can be forced to stop at the set point. Whether or not the abnormality signal is input is determined at the deceleration start point, and therefore, when it is determined that the abnormality signal is not input, the deceleration control by slide deceleration command calculation unit 46 is not performed. Rather, the normal pressing operation by slide speed command calculation unit 43 is continued. Because the deceleration control is not performed, decrease of the productivity can be suppressed.

When slide 3 is forced to stop at the set point, slide deceleration command calculation unit 46 instructs count unit 48 to count the period for which slide 3 is stopped at the set point. When the period for which slide 3 is stopped at the set point which is detected based on the result of counting by count unit 48 is a predetermined period or more, slide deceleration command calculation unit 46 instructs stoppage process unit 47 to stop the operation.

Stoppage process unit 47 follows the instruction from slide deceleration command calculation unit 46 to stop the overall operation of servo press 1. For example, stoppage process unit 47 may block supply of electric power from a power supply in order to stop the overall operation of servo press 1. By stopping supply of electric power from the power supply, the stability of servo press 1 in the abnormal state can be increased.

When slide 3 reaches the deceleration start point, slide deceleration command calculation unit 46 determines whether or not the abnormality signal is input through abnormality signal reception unit 45. If there is no input of the abnormality signal even when there has been input of the abnormality signal, slide deceleration command calculation unit 46 stops the deceleration control for slide 3 and controls slide 3 based on motion data. By this process, press working is performed based on acceleration control, and therefore, decrease of the productivity can be suppressed.

When input of the abnormality signal ends while slide 3 is stopped at the set point, stoppage of slide 3 is ended. Then, slide deceleration command calculation unit 46 restarts control of slide 3 from the set point based on motion data. By this process, slide 3 is forced to stop when there is an abnormality in transportation of a workpiece, but slide 3 is recovered when input of the abnormality signal ends, to thereby continue press working. Therefore, decrease of the productivity can be suppressed.

Servo motor 21, position detector 26 or angle detector 52, slide deceleration command calculation unit 46, stoppage determination calculation unit 44, control panel 6, count unit 48, and stoppage process unit 47 are respective examples of "drive unit," "detection unit," "speed control unit," "stoppage determination calculation unit," "display unit," "count unit," and "stoppage process unit."

<Slide Speed Control>

Figure 6:
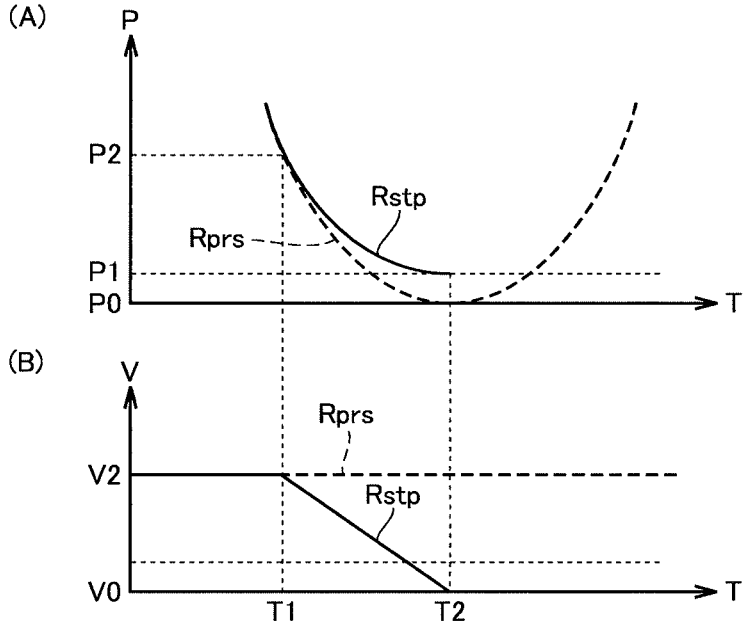
FIGS. 6A and 6B are diagrams illustrating speed control for a slide 3 based on an embodiment.

FIG. 6 is a diagram illustrating speed control for slide 3 based on an embodiment.

FIG. 6 (A) illustrates a case where the position of slide 3 is changed by speed control based on motion data.

FIG. 6 (B) illustrates a case where the speed of slide 3 is changed by speed control based on motion data.

In the present example, point P0 is a bottom dead center, point P1 is a set point, and point P2 is a deceleration start point.

In the embodiment, whether or not the abnormality signal is input is determined at deceleration start point P2. Specifically, when slide 3 reaches deceleration start point P2, slide deceleration command calculation unit 46 determines whether or not the abnormality signal is input through abnormality signal reception unit 45.

When the abnormality signal is input with the slide at deceleration start point P2, slide deceleration command calculation unit 46 performs deceleration control. When slide deceleration command calculation unit 46 determines that the abnormality signal is input with the slide at deceleration start point P2, slide deceleration command calculation unit 46 performs the control so that slide 3 is forced to stop at set point P1 (line Rstp).

In the illustrated case, slide deceleration command calculation unit 46 starts deceleration when the speed of slide 3 at time T1 is speed V2 and performs the control so that the speed of slide 3 reaches speed V0 (0) at time T2. In the illustrated case, slide 3 is forced to stop at set point P1 at time T2.

When the abnormality signal is not input at deceleration start point P2, slide speed command calculation unit 43 is not instructed to stop the speed control by slide deceleration command calculation unit 46. Accordingly, slide speed command calculation unit 43 causes press working to be performed on a workpiece at constant speed V2 (line Rprs).

Figure 7:
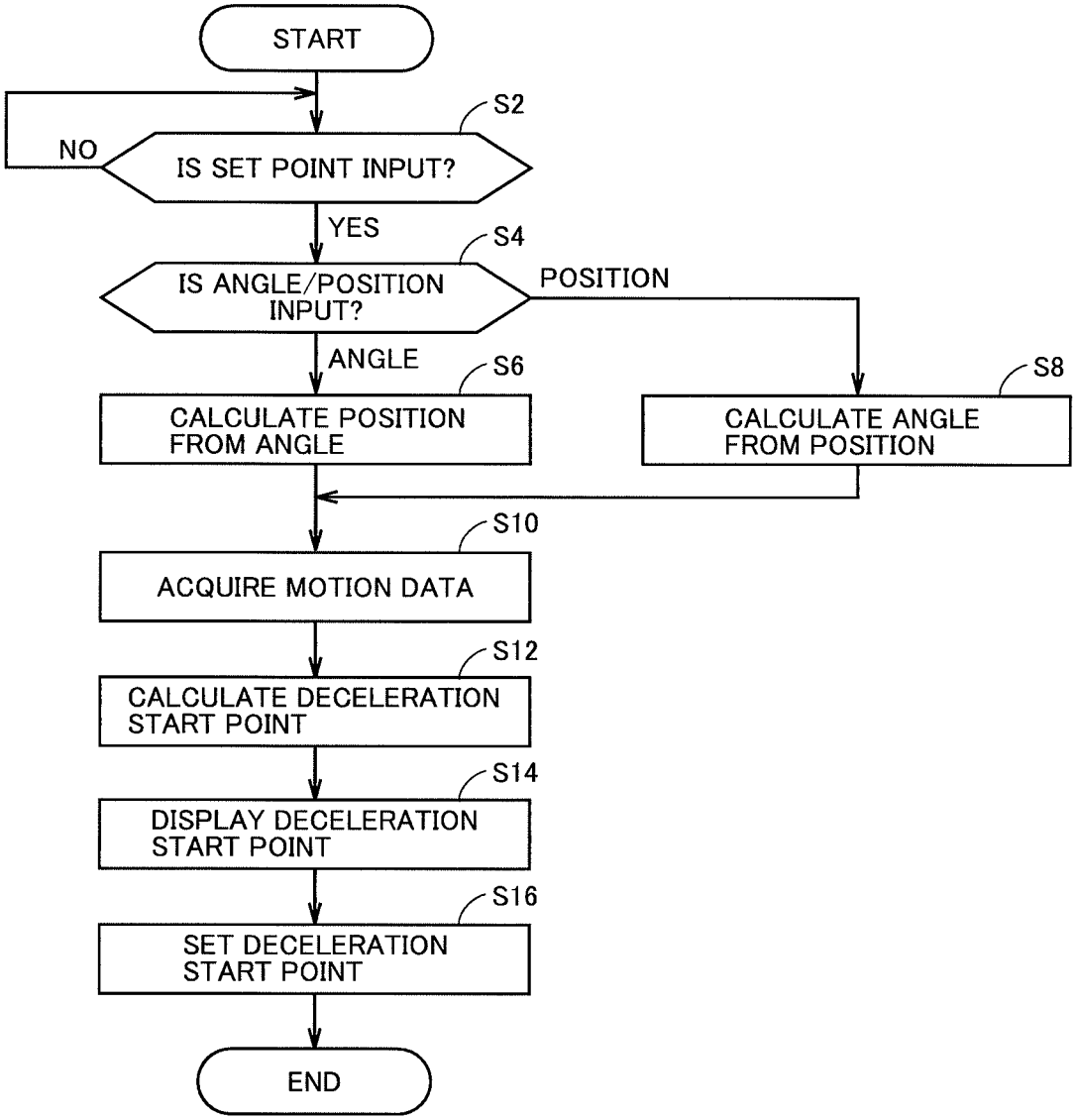
FIG. 7 is a flow diagram illustrating a process followed by a stoppage determination calculation unit 44 based on an embodiment.

FIG. 7 is a flow diagram illustrating a process followed by stoppage determination calculation unit 44 based on an embodiment.

As shown in FIG. 7, stoppage determination calculation unit 44 determines whether or not a set point is input (step S2). Specifically, it determines whether or not an instruction regarding a set point is input from an operator through control panel 6. The set point is a point where slide 3 is forced to stop in the case where an abnormality arises in transportation of a workpiece. The set point can be specified to prevent damage to the die in the case where such an abnormality arises.

FIG. 8 is a diagram illustrating display screens shown on control panel 6 based on an embodiment.

FIG. 8 (A) shows a set point input screen. Through the input screen, an operator can input a position or an angle at which the slide is to be forced to stop. As the angle, a rotational angle of a rotary can be input. By way of example, based on a correlation table defining an angle associated with a position, one of the angle and the position can be input to calculate the other.

Referring again to FIG. 7, when stoppage determination calculation unit 44 determines in step S2 that a set point is input (YES in step S2), stoppage determination calculation unit 44 determines whether an angle is input or a position is input as the set point (step S4). When stoppage determination calculation unit 44 determines in step S2 that a set point is not input (NO in step S2), it maintains the state in step S2.

When an angle is input as the set point in step S4 (ANGLE in step S4), stoppage determination calculation unit 44 calculates the position of the set point from the input angle (step S6). Specifically, it calculates the position of the set point from the angle which is input based on the correlation table.

When a position is input in step S4 (POSITION in step S4), stoppage determination calculation unit 44 calculates the angle from the position (step S8). Specifically, it calculates the angle of the set point from the position which is input based on the correlation table.

Stoppage determination calculation unit 44 then acquires motion data (step S10). Stoppage determination calculation unit 44 acquires the motion data which is set by motion setting unit 42.

Stoppage determination calculation unit 44 then calculates a deceleration start point based on the input set point and the motion data (step S12). Specifically, stoppage determination calculation unit 44 calculates, as the deceleration start point, an angle at which deceleration is to be started, based on the angle indicating the set point. It may calculate, as the deceleration start point, a position at which deceleration is to be started, based on the position indicating the set point.

By way of example, the distance at which the slide is stopped after the slide at speed V starts decelerating at uniform acceleration "a" can be calculated by determining $V^2/2a$. By way of example, the deceleration start point may be set at the point located at a distance of $V^2/2a$ above set point P1. Speed V and uniform acceleration "a" are herein acquired from the motion data. Speed V and uniform acceleration "a" to be set may vary depending on the motion. In the present example, the description is given of the case where the deceleration start point is set at which deceleration at uniform acceleration "a" is started. However, the acceleration is not limited to the uniform acceleration, and the deceleration start point can similarly be calculated even when the acceleration may vary depending on the motion data.

Stoppage determination calculation unit 44 then displays the calculated deceleration start point (step S14). Specifically, stoppage determination calculation unit 44 outputs to control panel 6 the information regarding the calculated deceleration start point.

FIG. 8 (B) shows a screen for confirmation of the deceleration start point.

In the present example, together with the set angle and the set position of the input set point, the angle at which deceleration is started and the position at which deceleration is started are shown as the calculated deceleration start point.

Referring again to FIG. 7, stoppage determination calculation unit 44 sets the calculated deceleration start point (step S16).

The process is then ended (END).

In this way, the deceleration start point at which deceleration of slide 3 is to be started can be calculated based on the input set point and the motion data.

Figure 9:
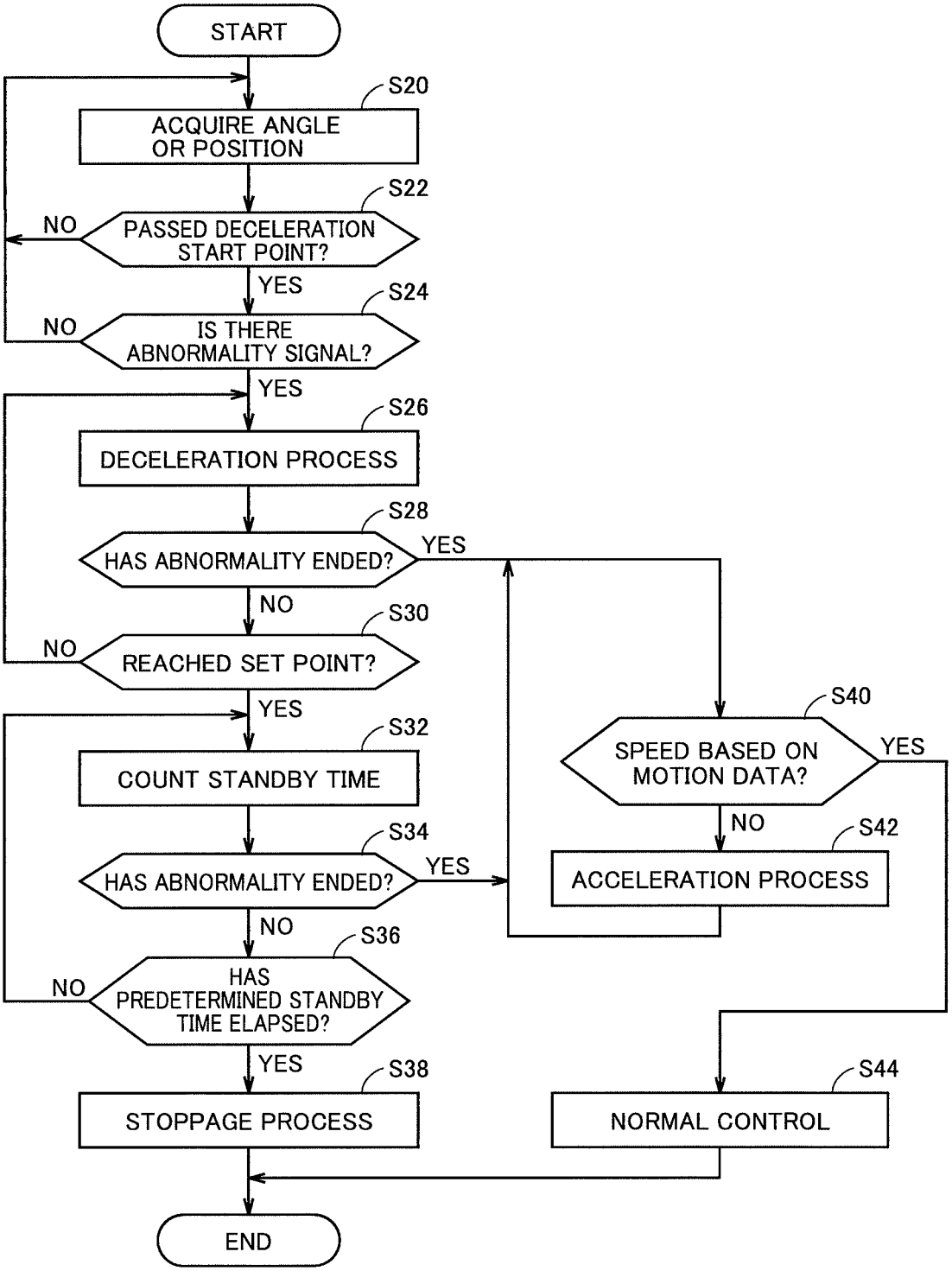
FIG. 9 is a flow diagram illustrating a process for controlling the speed of slide 3 by control device 40 based on an embodiment.

FIG. 9 is a flow diagram illustrating a process for controlling the speed of slide 3 by control device 40 based on an embodiment. A description is now given mainly of a process performed by slide deceleration command calculation unit 46.

As shown in FIG. 9, slide deceleration command calculation unit 46 acquires an angle which is input from angle detector 52 or a position which is input from position detector 26 (step S20). In the present example, the slide position information is detected based on the angle from angle detector 52 or the position from position detector 26.

Slide deceleration command calculation unit 46 then determines whether or not the slide has reached the set deceleration start point, based on the acquired angle or position (step S22).

Specifically, it determines whether or not the acquired angle has reached the deceleration start angle, or determines whether or not the acquired position has reached the deceleration start position.

When slide deceleration command calculation unit 46 determines in step S22 that the slide has reached the deceleration start point (YES in step S22), it determines whether or not the abnormality signal is input (step S24). Specifically, slide deceleration command calculation unit 46 determines whether or not the abnormality signal is input through abnormality signal reception unit 45.

When slide deceleration command calculation unit 46 determines in step S24 that the abnormality signal is input (YES in step S24), it performs deceleration control (step S26). Specifically, slide deceleration command calculation unit 46 performs the deceleration control for decelerating the slide and thereby stopping the slide at the set point as described above in connection with FIG. 6. Namely, the deceleration control is not performed until whether or not the abnormality signal is input is determined.

Slide deceleration command calculation unit 46 then determines whether or not the abnormality has ended (step S28). Specifically, slide deceleration command calculation unit 46 determines whether or not input of the abnormality signal through abnormality signal reception unit 45 has ended.

When slide deceleration command calculation unit 46 determines in step S28 that the abnormality has ended (YES in step S28), it proceeds to step S40.

When slide deceleration command calculation unit 46 determines in step S28 that the abnormality has not ended (NO in step S28), it determines whether or not the slide has reached the set point (step S30).

When slide deceleration command calculation unit 46 determines in step S30 that the slide has reached the set point (YES in step S30), it proceeds to step S32.

When slide deceleration command calculation unit 46 determines in step S30 that the slide has not reached the set point (NO in step S30), it returns to step S26 and continues the deceleration control. This process is repeated until slide 3 reaches the set point through the process.

When slide deceleration command calculation unit 46 determines in step S30 that the slide has reached the set point (YES in step S30), it then counts a standby time for which the slide is on standby at the set point (step S32). Specifically, slide deceleration command calculation unit 46 instructs count unit 48 to start counting, and count unit 48 accordingly starts counting.

Slide deceleration command calculation unit 46 then determines whether or not the abnormality has ended (step S34). Specifically, slide deceleration command calculation unit 46 determines whether or not input of the abnormality signal through abnormality signal reception unit 45 has ended.

When slide deceleration command calculation unit 46 determines in step S34 that the abnormality has ended (YES in step S34), it proceeds to step S40.

When slide deceleration command calculation unit 46 determines in step S34 that the abnormality has not ended (NO in step S34), it determines whether or not a predetermined standby time has elapsed (step S36). Specifically, based on the result of counting by the count unit, slide deceleration command calculation unit 46 determines whether or not a predetermined standby time has elapsed since the slide stopped at the set position.

When slide deceleration command calculation unit 46 determines in step S36 that the predetermined standby time has elapsed (YES in step S36), it performs a stoppage process (step S38). Specifically, slide deceleration command calculation unit 46 gives an instruction to stoppage process unit 47. Stoppage process unit 47 stops the overall operation of servo press 1 following the instruction from slide deceleration command calculation unit 46.

The process is then ended (END).

When slide deceleration command calculation unit 46 determines in step S36 that the predetermined standby time has not elapsed (NO in step S36), it returns to step S32 to count the standby time, and repeats the above process.

When slide deceleration command calculation unit 46 determines in step S28 or step S34 that the abnormality has ended (YES in step S28 or step S34), it determines whether or not the speed is controlled at the speed determined based on the motion data (step S40).

When slide deceleration command calculation unit 46 determines in step S40 that the speed is not controlled at the speed determined based on the motion data (NO in step S40), it performs an acceleration process (step S42).

Returning then to step S40, slide deceleration command calculation unit 46 repeats the acceleration process until the speed reaches the speed determined based on the motion data.

When slide deceleration command calculation unit 46 determines in step S40 that the speed is controlled at the speed determined based on the motion data (YES in step S40), it gives an instruction to perform normal control (step S44). Specifically, slide deceleration command calculation unit 46 instructs slide speed command calculation unit 43 to perform slide speed control in accordance with the motion data.

The process is then ended (END).

In this way, slide deceleration command calculation unit 46 determines, at the deceleration start point, whether or not the abnormality signal is input through abnormality signal reception unit 45. When the abnormality signal is input, slide deceleration command calculation unit 46 performs the deceleration control so that the slide is stopped at the set point. Even when the abnormality signal is input, the deceleration control for slide 3 is stopped if the input of the abnormality signal ends before the slide reaches the set point, and control of slide 3 based on the motion data is performed. When slide 3 has reached the set point and then the input of the abnormality signal ends during a predetermined standby time, the stoppage of slide 3 is ended and control of slide 3 is restarted from the set point based on the motion data.

Figure 10:
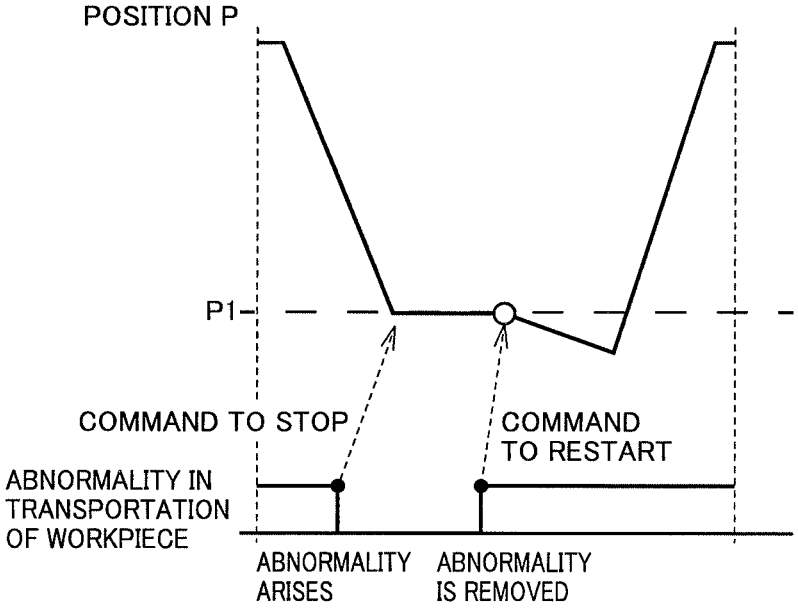
FIG. 10 is a diagram illustrating a relation between a slide position and an abnormality signal based on an embodiment.

FIG. 10 is a diagram illustrating a relation between the slide position and the abnormality signal based on an embodiment.

As shown in FIG. 10, if the abnormality signal is input when the slide reaches the deceleration start point, slide deceleration command calculation unit 46 performs deceleration control for slide 3. Accordingly, slide 3 is stopped at the set point.

If the abnormality is removed while slide 3 is stopped at the set point, slide 3 starts a recovery operation. Specifically, when slide deceleration command calculation unit 46 determines that the input of the abnormality signal through abnormality signal reception unit 45 has ended, it controls, from the set point, the slide at a speed in accordance with the motion data. After reaching the bottom dead center, slide 3 is lifted again and the normal process is repeated.

In the embodiment, if the abnormality is removed after slide 3 is stopped at the set point, the slide can recover to perform the press working. Conventionally, the operation is stopped when an abnormality is detected, so that supply of electric power from a power supply is stopped and thereby control of the whole servo press 1 is stopped, for example. In the present embodiment, when the abnormality is removed, the recovery control can be performed to continue the process.

It should be construed that the embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

1 servo press; 2 body frame; 3 slide; 3A spherical hole; 4 bed; 5 bolster; 6 control panel; 7 screw shaft; 7A sphere; 7B thread; 7C pin; 8 connecting rod body; 8A female thread; 9 connecting rod; 10 main shaft; 10A eccentric portion; 11 side frame; 12, 13, 14, 17, 18 bearing; 15 main gear; 16 power transmission shaft; 16A transmission gear; 19, 23 pulley; 21 servo motor; 21A output shaft; 22, 25 bracket; 24 belt; 26 position detector; 27 rod; 28 position sensor; 29 auxiliary frame; 31, 32 bolt; 33 slide position adjustment mechanism; 34 warm wheel; 35 warm gear; 36 input gear; 37 output gear; 38 induction motor; 40 control device; 42 motion setting unit; 43 slide speed command calculation unit; 44 stoppage determination calculation unit; 45 abnormality signal reception unit; 46 slide deceleration command calculation unit; 47 stoppage process unit; 48 count unit; 50 storage unit; 52 angle detector; 53 servo amplifier; 62 motion data storage unit; 100 coil holder; 110 leveller feeder; 111, 121 roller; 112, 122 motor; 113, 123 controller; 120 feeder

The invention claimed is:

1. A press machine configured to transport and press a workpiece, the press machine comprising:

a slide configured to vertically reciprocate for pressing the workpiece;

a drive unit configured to drive the slide;

a detection unit configured to detect positional information about the slide;

a stoppage determination calculation unit configured to set a deceleration start point at which deceleration of the slide is to be started, based on motion information defining operation of the slide and a set point at which the slide is to be forced to stop; and a speed control unit configured to determine whether an abnormality signal regarding transportation of the workpiece is input, when the slide reaches the deceleration start point based on the positional information about the slide detected by the detection unit, perform deceleration control for the slide so that the slide is stopped at the set point, when the speed control unit determines that the abnormality signal is input, determine whether input of the abnormality signal ends while the deceleration control for the slide is performed, and perform acceleration control for the slide by the drive unit based on the motion information, when the speed control unit determines that the input of the abnormality signal ends, wherein the speed control unit is configured to prior to performing the deceleration control, determine whether input of the abnormality signal ends, when the speed control unit determines that the abnormality signal is input.

2. The press machine according to claim 1, further comprising a display unit configured to display the set deceleration start point.

3. The press machine according to claim 1, wherein the stoppage determination calculation unit is configured to receive input of the set point at which the slide is to be forced to stop.

4. The press machine according to claim 1, further comprising:

a count unit configured to count a period for which the slide is stopped at the set point; and a stoppage process unit configured to stop supply of electric power, when the slide is stopped for a predetermined period or more based on a result of counting by the count unit.

* * * * *